United States Patent [19]

Allen

[11] Patent Number: 4,702,640

[45] Date of Patent: Oct. 27, 1987

[54] ROTATING TUBE CONCRETE FINISHER

[75] Inventor: J. Dewayne Allen, Paragould, Ark.

[73] Assignee: Allen Engineering Corporation, Euless, Tex.

[21] Appl. No.: 889,190

[22] Filed: Jul. 23, 1986

[51] Int. Cl.[4] ..... E01C 19/23; E01C 19/24

[52] U.S. Cl. ..... 404/75; 404/96; 404/97; 404/103; 404/104; 404/117; 404/127; 404/131; 425/458

[58] Field of Search ..... 404/75, 96, 97, 103, 404/104, 117–120, 122, 127, 131; 425/458

[56] References Cited

U.S. PATENT DOCUMENTS

| | | | |
|---|---|---|---|
| 910,073 | 1/1905 | Lischke | 404/119 |
| 1,302,275 | 4/1919 | Ashmore | 404/124 |
| 1,364,604 | 1/1921 | Ashmore | 404/117 |
| 1,364,605 | 1/1921 | Ashmore | 404/117 |
| 1,591,593 | 7/1926 | Weller et al. | 404/119 |
| 1,626,879 | 5/1927 | Shidler et al. | 404/124 |
| 1,736,413 | 11/1929 | Lichtenberg | 404/103 |
| 1,760,596 | 5/1930 | Heltzel | 404/122 |
| 1,894,408 | 1/1933 | MacKenzie | 404/117 |
| 2,025,703 | 12/1935 | Bailey et al. | 404/117 |
| 3,242,835 | 3/1966 | Paramythioti | 404/127 |
| 3,515,043 | 6/1970 | Austin | 404/103 |
| 3,532,032 | 10/1970 | Weber | 404/131 X |
| 3,547,014 | 12/1970 | Austin | 404/117 |
| 3,605,577 | 9/1971 | Bik | 404/122 |
| 3,801,211 | 4/1974 | Perkins | 404/103 |
| 4,142,815 | 3/1979 | Mitchell | 404/103 |
| 4,208,151 | 6/1980 | Cross | 404/122 |
| 4,213,749 | 7/1980 | Morrison | 404/119 X |

OTHER PUBLICATIONS

Allen Engineering, "Razorback Roller Finisher" brochure.

*Primary Examiner*—Stephen J. Novosad
*Assistant Examiner*—John F. Letchford
*Attorney, Agent, or Firm*—Cahill, Sutton & Thomas

[57] ABSTRACT

A rotating tube concrete finisher is controlled and driven by an end handle assembly including an internal combustion engine. An outrigger wheel unit is coupled to the end handle assembly to form a stable end support for the end handle assembly and to support the weight of the end handle assembly including the engine. A pair of end handle assemblies can be coupled to opposing ends of a cylindrical finishing roller and may be selectively operated to drive the finishing roller in either a first or a second direction of rotation. A winch system facilitates uphill and downhill translation of the concrete finisher on a sloping concrete surface and enables the system to be operated by one man without undue effort.

16 Claims, 10 Drawing Figures

20
10A
10B
12
15
16
1A

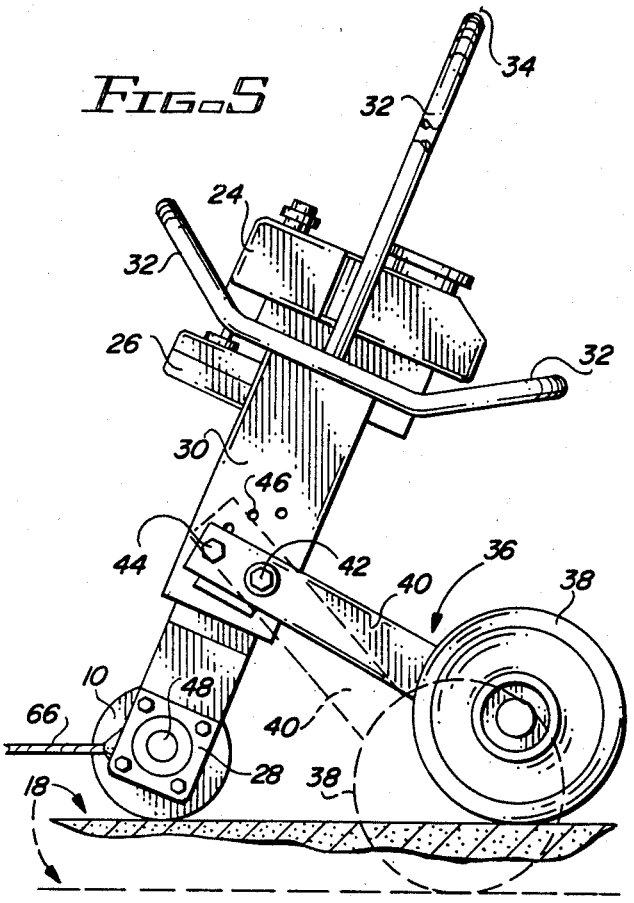
FIG. 5
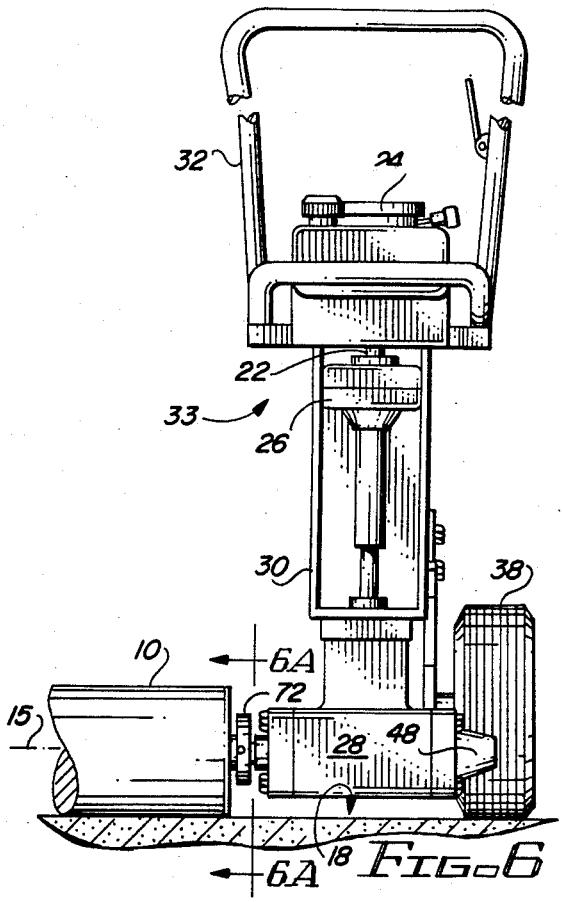
FIG. 6
FIG. 6A
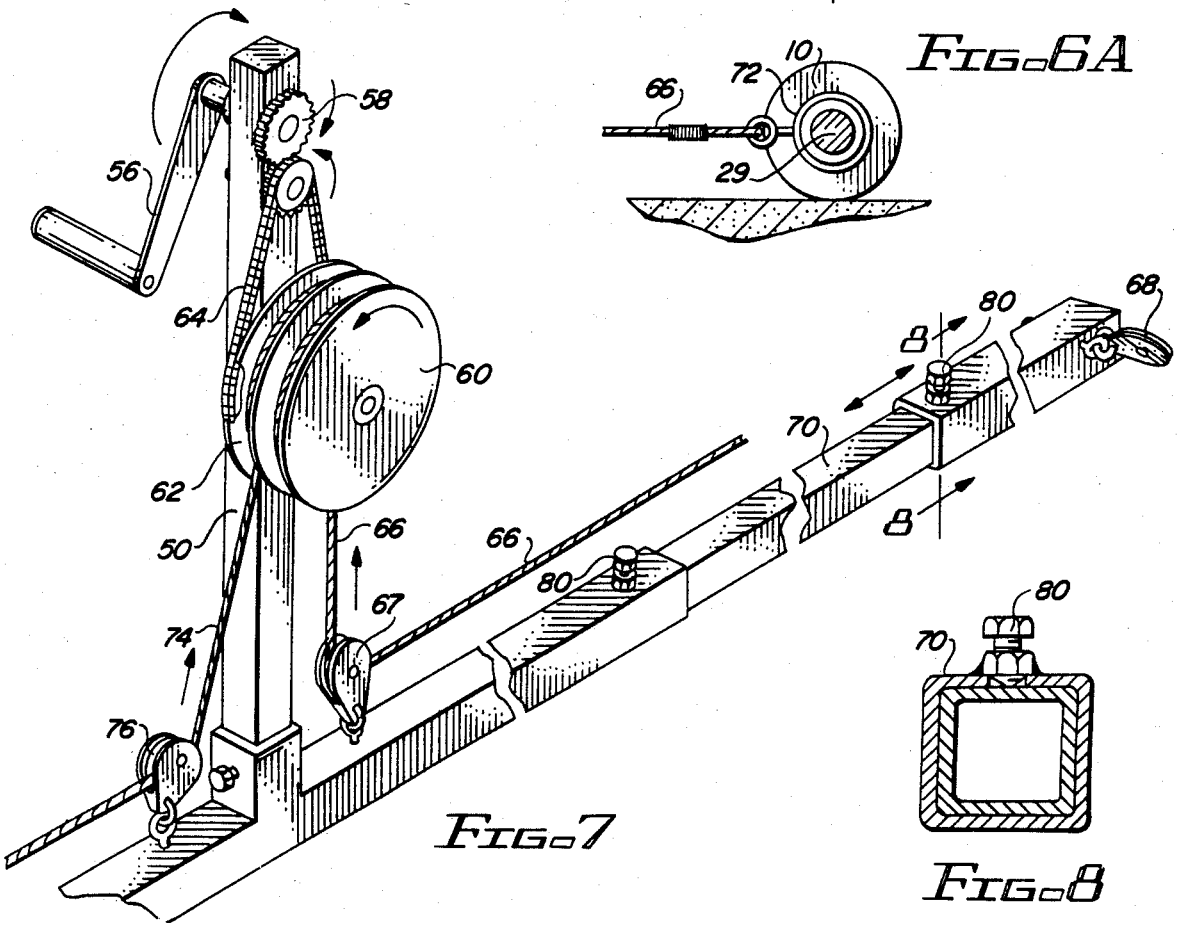
FIG. 7
FIG. 8

ROTATING TUBE CONCRETE FINISHER

BACKGROUND OF THE INVENTION

1. Field of the Invention

This invention relates to concrete finishing apparatus, and more particularly, to concrete finishing apparatus utilizing a rotating cylindrical finishing roller.

2. Description of the Prior Art

Many different engine driven rotating tube concrete finishing equipment have been manufactured and marketed in the past. Such equipment typically includes an end handle assembly rotatably coupled to the end of a rotatable cylindrical finishing roller. An internal combustion engine operates through a gear reduction unit and a ninety degree coupling to rotate the finishing roller in a single direction.

Because it was necessary for the operators of such prior art finalizing equipment to support the comparatively heavy end handle assembly which includes an internal combustion engine as well as to drag the heavy end handle assembly and the attached steel finishing roller during finishing operations, these operators soon become physically exhausted.

In addition, when such single engine, manually supported concrete finishing equipment is used to finish a sloped plastic concrete surface, two operators must manually push or pull the concrete finishing unit uphill and downhill along the sloping surface. To accomplish the required number of finishing passes on the sloping concrete surface, the operators of a single engine unit must reposition the finishing unit at the opposite end of the pours after each pass and repeat the finishing operation. An immediate reversal in the direction of the finishing pass cannot be accomplished because the finishing roller must be rotated into the concrete against the direction of machine travel and the prior art engine driven rotating tubes can only be rotated in a single direction by a gas engine. Tube rotation reversal can only be accomplished with such prior art equipment by horizontally rotating the entire machine one hundred and eighty degrees, an impractical procedure. Repositioning the machine after each finishing pass represents an inefficient, time consuming operation, but is necessary to achieve the necessary relationship between machine travel and tube rotation direction.

SUMMARY OF THE INVENTION

It is therefore a primary object of the present invention to provide a rotating tube concrete finisher incorporating end handle support means which supports the weight of the end handle and engine assembly.

Another object of the present invention is to provide a rotating tube concrete finisher having a first end handle assembly coupled to one end of a cylindrical finishing roller for rotating the finishing roller in one direction in combination with a second end handle assembly coupled to the opposite end of the roller for rotating the finishing roller in the opposite direction.

Yet another object of the present invention is to provide a rotating tube concrete finisher incorporating first and second spaced apart end handle assemblies coupled to the respective ends of a finishing roller, each of which includes end handle support means for engaging a load bearing surface adjacent to an area of plastic concrete for maintaining the end handle at a fixed angle of inclination with respect to the concrete surface.

Yet another object of the present invention is to provide a rotating tube concrete finisher having a winching system operable in combination with a single engine driven handle assembly on a sloping concrete surface to enable a single operator to move the concrete finisher both uphill and downhill.

Yet another object of the present invention is to provide a rotating tube concrete finisher having a winching system operable in combination with first and second spaced apart engine driven end handle assemblies on a sloping concrete surface to enable a single operator to move the concrete finisher both uphill and downhill and to selectively energize an appropriate engine to drive the finishing roller in a first direction during upward movement and in a second direction during downward movement to accomplish continuous concrete finishing operations as the finisher is moved uphill and then downhill on the sloping pour.

Briefly stated, and in accord with one embodiment of the invention, a rotating tube concrete finisher operates to finish the surface of an area of plastic concrete placed adjacent to first and second spaced apart load bearing sides which generally define the width of that area. The finisher includes an elongated cylindrical finishing roller supported either by a concrete form or by the first and second load bearing sides of the plastic concrete area. The finishing roller includes first and second ends, a longitudinal axis and a length exceeding the width of the area. The concrete finisher includes an end handle having a length, upper and lower ends and a lengthwise axis. Rotatable coupling means rotatably couples the end handle to the first end of the roller and maintains the lengthwise axis of the end handle oriented perpendicular to the longitudinal axis of the roller. Rotary drive means is coupled to the end handle and to the roller and rotates the roller in a first direction to cause the rotating cylindrical surface of the roller to smooth and finish the plastic concrete surface. End handle support means is coupled along the length of the end handle at a location spaced apart from the lower end of the end handle and engages the first load bearing side of the area to provide low friction engagement with the first load bearing side, to maintain the lengthwise axis of the end handle inclined at a fixed angle with respect to the vertical end to transfer a portion of the weight of the end handle/rotary drive means assembly to the first load bearing side.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

FIG. 5 is a side elevational view of the end handle-/engine drive unit depicted in FIG. 1.

FIG. 6 is a front elevational view of the end handle-/engine unit depicted in FIG. 5.

FIG. 6A is a sectional view of the concrete finisher depicted in FIG. 6, taken along section line 6A—6A.

FIG. 7 is a partially cutaway perspective view of a second embodiment of the winch system of the present invention.

FIG. 8 is a sectional view of the telescopic spreader bar depicted in FIG. 7, taken along section line 8—8.

DESCRIPTION OF THE PREFERRED EMBODIMENT

Figures 1, 1A, 2, 3, 4:
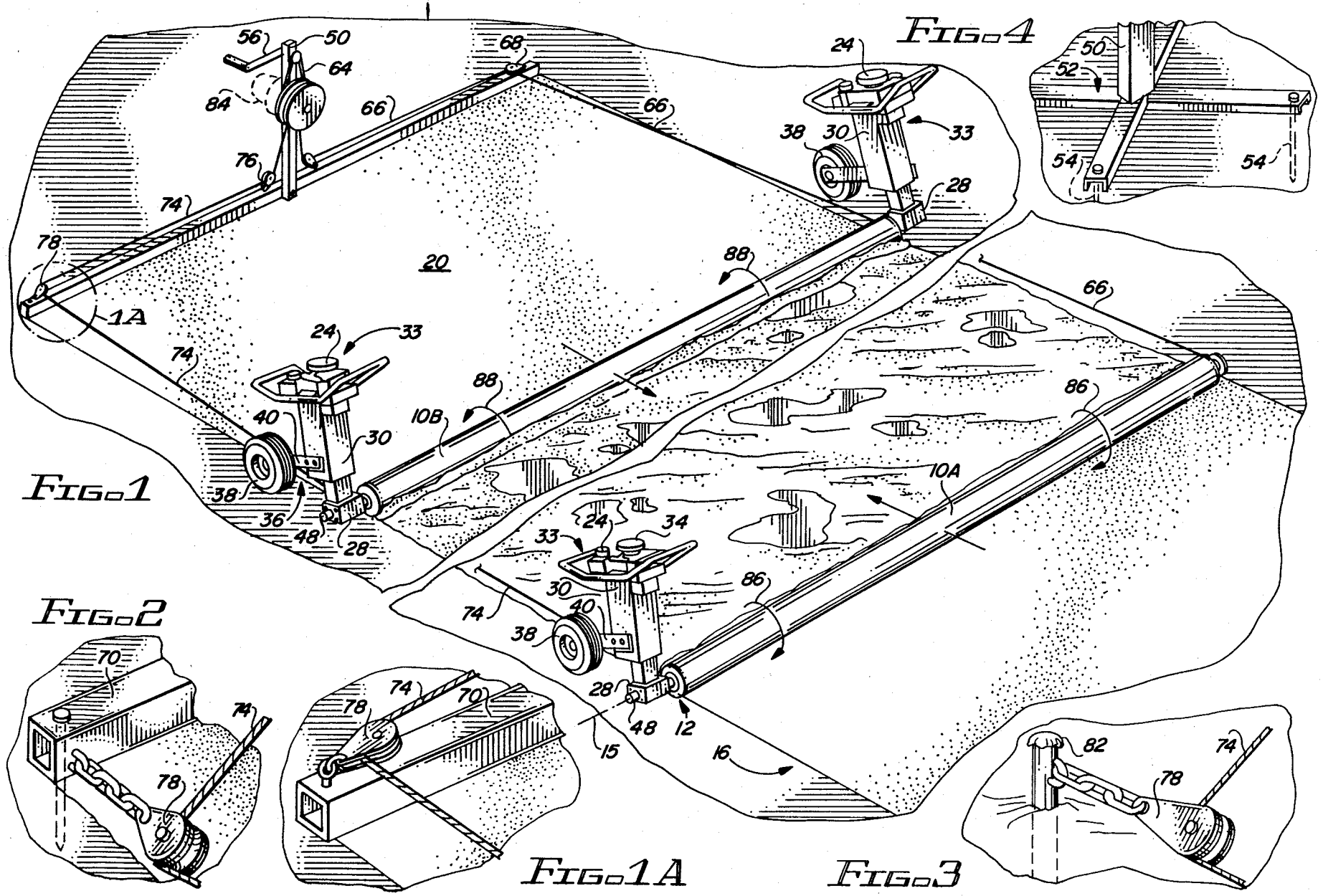
FIG. 1 is a perspective view of the concrete finisher of the present invention depicting an dual engine embodiment in combination with a winch system.
FIG. 1A is an enlarged, partially cutaway perspective view of a selected portion of FIG. 1 showing the spreader bar end.
FIG. 2 depicts a spreader bar end staked to the ground.
FIG. 3 depicts an alternative method for securing the pulley depicted in FIG. 2.
FIG. 4 illustrates the manner in which the winch stand depictec in FIG. 1 may be secured to the ground.

In order to better illustrate the advantages of the invention and its contributions of the art, a preferred hardware embodiment of the invention will now be described in detail.

Referring to FIGS. 1, 5 and 6, the rotating tube concrete finisher of the present invention includes an elongated cylindrical finishing roller 10 having a first end 12 and a second end 14. Roller 10 includes a longitudinal axis 15 extending through the center of the cylindrical roller. The length of roller 10 is selected to exceed the width of an area in which plastic concrete is placed. As illustrated in FIG. 1, a first load bearing side surface 16 and a second load bearing side surface 18 generally define the width of the area of plastic concrete designated by reference number 20. Load bearing sides 16 and 18 may take the form of previously cured or hardened concrete, a concrete form, or a firm earthen shoulder area.

The rotating output shaft 22 of an internal combustion engine 24 is coupled through a centrifugal clutch (not shown) to a gear reduction unit 26 and then to a ninety degree drive coupling 28 which converts the vertically oriented rotating motion of the engine drive shaft 22 into horizontally oriented rotating motion of an output shaft 29. The output shaft from coupling 28 is coupled to rotate one of the ends of finishing roller 10.

A bracket 30 couples the base of engine 24 to the upper surface of ninety degree drive coupling 28. A handle 32 is rigidly secured to the upper surface of bracket 30.

Handle 32, parts of engine 24, bracket 30 and the exterior surface of drive coupling 28 function as an end handle assembly 33 which enables an operator to control the concrete finisher and to steer and direct the finisher as it is being used to finish the upper surface of plastic concrete.

Ninety degree drive coupling 28 functions as rotatable coupling means which rotatably couples end handle assembly 33 to the end of finishing roller 10 and which also maintains the lengthwise axis 34 of end handle assembly 33 oriented perpendicular to the longitudinal axis 15 of finishing roller 10.

Engine 24, the centrifugal clutch (not shown), gear reduction unit 26 and ninety degree drive coupling 28 function as rotary drive means which is coupled both to end handle assembly 33 and to finishing roller 10 and rotates roller 10 in a first direction. When engine 24 is shut down, the centrifugal clutch disconnects the now stationary engine output shaft from gear reduction unit 26. In the shut down configuration, finishing roller 10 is freely rotatable in either direction since it is decoupled from the output shaft of engine 24 by the centrifugal clutch.

End handle support means designated generally by reference number 36 includes a wheel 38 which is rotatably coupled to one end of a strut 40. The opposite end of strut 40 is rigidly coupled to bracket 30 which forms a part of end handle assembly 33. Wheel 38 of end handle support means 36 is configured to engage the first load bearing side 16 to provide low friction engagement with that load bearing surface. This wheel plus strut assembly also maintains the lengthwise axis 34 of end handle assembly 33 inclined at a fixed angle with respect to a vertically oriented axis extending through the first end 12 of finishing roller 10. End handle support means 36 also serves to transfer a portion of the weight of the end handle assembly 33 unit to load bearing side 16.

Strut 40 is pivotally coupled to bracket 30 by a first bolt 42 which permits the angle between strut 40 and bracket 30 to be varied. A second bolt 44 passes through one of a plurality of spaced apart apertures 46 to fix the angle between strut 40 and bracket 30.

The angle between strut 40 of end handle support means 36 and bracket 30 may be varied to accommodate human operators of varying height. For a short operator, strut 40 will be rotated into a more nearly horizontal position to enable axis 34 to be inclined further toward the horizontal. This strut orientation lowers the elevation of handle 32 with respect to load bearing surface 16. For taller operators, the angle between axis 34 and the horizontal will be increased to elevate handle 32 further above load bearing surface 16.

As illustrated in FIG. 5, wheel 38 may contact and be supported by either an adjacent side surface of cured concrete or a concrete form as shown by the solid line depiction, or by an adjacent side surface of firmly compacted dirt as shown in the dotted line depiction. In this latter configuration, strut 40 will be rotated to a more nearly vertical position to maintain handle axle 34 at an appropriate inclination.

Because end handle assembly 33 is maintained pependicular to the longitudinal axis 36 of finishing roller 10 by drive coupling 28 and because a fixing spacing is maintained between drive coupling 28 and wheel 38, the combination of end handle assembly 33, finishing roller 10 and handle support means 36 forms a completely stable, load bearing, non-tilting support at each end of roller 10. Because the center of gravity of end handle assembly 33 is maintained on the wheel 38 side of finishing roller 10, end handle assembly 33 will not fall to the ground by rotating backwards and away from wheel 38. Care should be exercised, however, to avoid adjusting the inclination angle between strut 40 and bracket 30 such that the end handle assembly 33 is placed in a near-vertical position where torque reaction forces might tip end handle assembly 33 over backwards.

In the most straight-forward embodiment of the invention, a single engine driven end handle assembly 33 in combination with a single end handle support means is coupled to one end of finishing roller 10A to finish a horizontal concrete slab. A rigid handle or a non-rigid cord is rotatably coupled by a bearing assembly to the opposite end of finishing roller 10A in a manner well known to those skilled in the art. Engine 24 rotates finishing roller 10 in a single direction while one operator grasps end handle assembly 33 at one end of the finisher and a second operator grasps the non-engine driven handle unit at the opposite end of roller 10A. The two operators then pull the concrete finisher into an area of unfinished plastic concrete while finishing roller 10A is rotated by the engine in a direction opposite to the direction of travel of the concrete finisher. The end handle support means 36 in the form of wheel 38 and strut 40 supports the load of engine 24, handle 32 and the various other elements of end handle assembly 33 and substantially lessens the operator work load.

The dual-engine embodiment of the invention depicted in FIG. 1 is utilized to spin finishing roller 10B in either a first direction or in a second opposite direction. When the concrete finisher depicted in FIG. 1 is moved uphill from right to left across a freshly poured, sloping concrete surface 20, engine 24 of the near-side end handle assembly 33 is operated while the engine 24 of the far-side end handle assembly 33 is shut down. The non-operating far-side engine is decoupled from its now-rotating gear box 26 by normal action of the centrifugal clutch located between the engine drive shaft and the input shaft of gear box 26.

When roller 10B of the concrete finisher depicted in FIG. 1 is moved downhill from left to right into the plastic concrete surface, the near-side engine is shut down and the far-side engine is started. Because the near-side and far-side end handle assemblies 33 are identical and because ninety degree drive coupling 28 includes dual ended, counter rotating output shafts, one end of which is normally covered by a cap 48, the desired reverse roller rotation can be obtained either by facing the engines on the two end handle assemblies in opposite directions or by facing both engines in the same direction as depicted in FIG. 1, utilizing opposing output shafts of drive couplings 28 to drive finishing roller 10B and by connecting wheel 38 and strut 40 to the outboard surface of bracket 30.

In another embodiment of the invention, a winch system is used in combination either with single engine concrete finisher to assist in moving the finisher up and down a sloping plastic concrete surface. The single and dual end handle assembly finishing equipment described above may be used on either level or sloping plastic concrete surfaces. The winch system facilitates use on sloping surfaces.

A winch stand 50 includes either an "X"-shaped base 52 or a square plate base which is secured to the underlying surface by a plurality of spikes 54 or other equivalent means for maintaining winch stand 50 in a fixed position in proximity to the upper edge of the concrete surface area. The wheel of a pick-up truck, backhoe or any heavy object can also be used to support base 52.

As illustrated in FIGS. 1 and 7, a simplified winch system is fabricated from a hand crank 56, a dual-sprocket gear reduction element 58, and first and second winch drums 60 and 62 which are securely coupled together and interconnected with gear reduction unit 58 by drive chain 64. Winch drums incorporate equal diameter drums to move winch cables 66 and 74 at precisely the same speed to maintain a fixed orientation of roller axis 15 with respect to concrete surface 20 as the roller is moved either toward or away from the winch system.

A first winch cable 66 is routed outward from winch drum 60 through pulleys 67 and 68 which are secured to spreader bar 70. Pulleys 67 and 68 are not essential and may be omitted. As depicted in FIG. 1, spreader bar 70 may be positioned behind winch stand 50 or, as illustrated in FIG. 7, may be coupled coaxially around winch stand 50. As illustrated in FIGS. 6 and 6A, the end of winch cable 66 is rotatably coupled to the end of finishing roller 10 by a bearing assembly 72 which permits upward traction force to be exerted on the end of finishing roller 10 without transmitting the rotating motion of roller 10 to winch cable 66. A similar winch to finisher coupling configuration interconnects winch drum 62 via second winch cable 74 through pulleys 76 and 78 to another bearing assembly 72 coupled to the opposite end of finishing roller 10.

Spreader bar 70 serves to maintain pulleys 68 and 78 substantially aligned with but somewhat outboard of load bearing sides 16 and 18 of the concrete surface area 20. As depicted in FIGS. 7 and 8, the length of spreader bar 70 may be telescopically adjusted and locked in place by locking bolts 80.

In an alternative embodiment of the invention, spreader bar 70 may be omitted and as illustrated in FIG. 3, a single spike 82 maintains pulley 78 in the desired outrigger position explained above.

As illustrated by the dotted line depiction located behind winch drums 60 and 62 in FIG. 1, a motor driven winch assembly 84 may be substituted for hand crank 56. The winch may also be powered by an electric motor, a gasoline engine, a hydraulic motor or comparable devices.

The method for finishing an uphill to downhill sloping surface of an area of plastic concrete will now be described by referring to FIG. 1. Finishing roller 10B is initially positioned near the lower or downhill edge of the sloping concrete surface. An operator configures the winch system and winch cables 66 and 74 as illustrated in FIG. 1 to orient the longitudinal axis 15 of finishing roller 10B parallel to the lower edge of the plastic concrete surface. Since the finishing roller will initially be moved upward along the uphill sloping concrete surface, the engine which drives roller 10B in a downhill climbing direction indicated by reference arrows 86 is started and the motor throttle is set to the desired operating RPM. The operator then rotates winch crank 56 to slowly but uniformly move finishing roller 10B from the lower edge of the plastic concrete surface uphill until the upper edge of the concrete area is reached. At that point, the single operating engine is shut down and the opposing engine is started to rotate finishing roller 10B in the uphill climbing direction indicated by reference arrows 88. The operator then rotates winch crank 56 in the opposite direction to slowly but uniformly move finishing roller 10B from the uphill position back to the lower edge of plastic concrete surface 20. This procedure can be repeated as many times as is necessary to achieve an appropriate surface finish.

To achieve the same result described above, a reversible gear reduction unit 26 or other means for reversing the direction of rotation of the output shaft of engine 24 such as a reversing transmission positioned above drive unit 28 could be utilized to reverse the direction of rotation of finishing roller 10 after it has reached the uphill edge of the plastic concrete surface. In this embodiment, the second end handle 33 plus engine assembly could be eliminated.

The winch system of the present invention may also be used with the single roller 10A configuration of the concrete finisher. After roller 10A has been winched to the top of the slab, the rotation of roller 10A is stopped and the finisher is winched down to the bottom of the slab to commence another bottom to top finisher operation.

Because of the inherent stability of each end handle assembly 33 achieved by use of the end handle support means 36 comprising wheel 38 and strut 40, a single operator can set up the slope finishing system described above, activate the selected engine, operate the winch system, shut down the first engine and start the second engine, and operate the winch system to move the concrete finisher from the top to the bottom of the sloped surface. To achieve faster operating times, an unskilled helper may be used to periodically start and stop the engines on the opposing end handle assemblies 33. The winch system of the present invention also enables a single worker to operate the single engine concrete finisher.

It will be apparent to those skilled in the art that the disclosed rotating tube concrete finisher may be modified in numerous ways and may assume many embodiments other than the preferred forms specifically set out and described above. For example, an internal combustion engine having a horizontally oriented output shaft could be coupled by a drive belt to rotatably drive an end of finishing roller 10 thus avoiding the requirement for gear box 26 and for ninety degree drive coupling 28. The appropriate gear reduction could be achieve by selection of appropriate drive pulley diameters. In addition, numerous different winch system configurations could be implemented to move finishing roller 10 up and down along a sloping plastic concrete surface without significantly deviating from the scope of the present invention. Accordingly, it is intended by the appended claims to cover all such modifications of the invention which fall within the true spirit and scope of the invention.

I claim:

1. A method for finishing an uphill to downhill sloping surface of an area of plastic concrete having upper and lower edges defining the length of said area and first and second load bearing side surfaces defining the width of said area, said method comprising:

a. positioning an elongated cylindrical finishing roller having first and second ends, a longitudinal axis and a length exceeding the width of said area across the lower edge of said area with the first and second ends of said roller being supported by said first and second load bearing side surfaces of said area and the lower surface of said roller contacting the plastic concrete surface;

b. gripping the first end of said roller with first rotary drive means and rotating said roller in a downhill climbing direction;

c. providing a winch system spaced apart from said roller and including i. a first winch drum having a first winch cable coupled to first bearing means;

ii. a second winch drum having a second winch cable coupled to second bearing means;

iii. a winch stand for anchoring said winch system in proximity to the first edge of said area and for maintaining said first and second winch drums elevated above the surface of the plastic concrete;

d. securing said winch system to a stationary object in proximity to the upper edge of said area;

e. providing first and second bearing means for rotatably coupling the first and second winch cables to the first and second ends of said roller;

f. operating said winch system to move said roller from the lower edge of said area uphill along the length of said area to the upper edge of said area;

g. gripping the second end of said roller with second rotary drive means and rotating said roller in an uphill climbing direction; and h. operating said winch system to move said roller from the upper edge of said area downhill along the length of said area to the lower edge of said area.

2. The method of claim 1 wherein said roller is moved uphill and downhill along the length of said area without deflecting the longitudinal axis of said roller in a horizontal plane.

3. The method of claim 1 wherein said traction means includes:

a. first winch drum for exerting the traction force on said first winch cable; and b. a second winch drum for exerting the traction force on said second winch cable.

4. The method of claim 1 wherein said winch system further includes a spreader bar coupled to said winch stand, said spreader bar including a first end extending outward from said winch stand to the first load bearing side surface and a second end extending outward from said winch stand to the second load bearing side surface.

5. Apparatus for finishing the surface of an area of plastic concrete placed within first and second spaced apart load bearing side surface defining the width of said area, comprising:

a. an elongated cylindrical finishing roller supported by the first and second load bearing side surfaces of said area and having first and second ends, a longitudinal axis and a length exceeding the width of said area, the lower surface of said roller contacting the surface of said plastic concrete;

b. an end handle having a length, upper and lower ends, and a lengthwise axis;

c. first rotatable coupling means for rotatably coupling said end handle to the first end of said roller and for maintaining the lengthwise axis of said end handle oriented perpendicular to the longitudinal axis of said roller;

d. first rotary drive means coupled to said end handle and to said roller for rotating said roller in a first direction to cause the rotating lower cylindrical surface of said roller to smooth and finish the plastic concrete surface;

e. end handle support means coupled along the length of said end handle at a location spaced apart from the lower end of said handle and engaging the first load bearing side surface of said area for providing low friction engagement with the first load bearing side surface, for maintaining the lengthwise axis of said handle inclined at a fixed angle with respect to a vertically oriented axis extending through the first end of said roller, and for transferring a portion of the weight of said end handle/rotary drive means unit to the first load bearing side surface of said area; and f. traction means spaced apart from said roller, attached to a stationary object and including first and second cables coupled to said roller for exerting a traction force on the first and second ends of said roller to move said roller along the length of plastic concrete, said traction means including a winch system with i. a first winch drum having a first winch cable for exerting the traction force on the first end of said roller;

ii. a second winch drum having a second winch cable for exerting the traction force on the second end of said roller; and iii. a winch stand for anchoring said winch system in proximity to the first end of said area and for maintaining said first and second winch drums elevated above the surface of the plastic concrete.

6. The apparatus of claim 5 wherein said first rotary drive means selectively rotates said roller in either first or second directions.

7. The apparatus of claim 5 wherein said rotary drive means includes an internal combustion engine.

8. The apparatus of claim 5 further including:

a. a second end handle having a length, upper and lower ends and a lengthwise axis; and b. second rotatable coupling means for rotatably coupling said second end handle to the second end of said roller and for maintaining the lengthwise axis of said second end handle oriented perpendicular to the longitudinal axis of said roller; and c. second rotary drive means coupled to said second end handle and to the second end of said roller for rotating said roller in a second direction to cause the rotating lower cylindrical surface of said roller to smooth and finish the plastic concrete surface.

9. The apparatus of claim 5 wherein said traction means further includes:

a. first bearing means rotatably coupling the first winch cable to the first end of said roller; and b. second bearing means rotatably coupling the second winch cable to the second end of said roller.

10. The apparatus of claim 5 wherein said end handle support means includes:

a. a wheel for engaging said first load bearing side surface; and b. a strut having a first end rotatably coupled to said wheel and a second end rigidly coupled to said end handle.

11. The apparatus of claim 10 wherein said end handle support means includes means for adjusting the angle between said strut and said end handle to vary the angle of inclination between the lengthwise axis of said end handle and a vertically oriented axis extending through the first end of said roller.

12. The apparatus of claim 5 wherein said winch system further includes a spreader bar coupled to said winch stand and including a first end extending outward from said winch stand to the first load bearing side surface and a second end extending outward from said winch stand to the second load bearing side surface for guiding said first and second winch cables outward from said winch stand to the first and second load bearing side surfaces of said area.

13. The apparatus of claim 12 wherein said spreader bar further includes:

a. a first pulley coupled to the first end of said spreader bar for redirecting the first winch cable along the first side surface of said area to said first bearing means; and b. a second pulley coupled to the second end of said spreader bar for redirecting the second winch cable along the second side surface of said area to said second bearing means.

14. Apparatus for finishing an uphill to downhill sloping surface of an area of plastic concrete having upper and lower edges defining the length of said area and first and second load bearing side surfaces defining the width of said area, comprising:

a. an elongated cylindrical finishing roller having first and second ends, a longitudinal axis and a length exceeding the width of said area, the lower surface of said roller contacting the surface of the plastic concrete;

b. an end handle having a length, upper and lower ends, and a lengthwise axis;

c. first rotatable coupling means for rotatably coupling said end handle to the first end of said roller and for maintaining the lengthwise axis of said end handle oriented perpendicular to the longitudinal axis of said roller;

d. first rotary drive means coupled to said end handle and to said roller for rotating said roller in a first direction to cause the rotating lower cylindrical surface of said roller to smooth and finish the plastic concrete surface;

e. traction means spaced apart from said roller and attachable to a stationary object in proximity to the upper edge of said area for exerting a traction force on the first and second ends of said roller to move said roller along the length of said area of plastic concrete, said traction means including a winch system with i. a first winch drum having a first winch cable coupled to first bearing means for rotatably interconnecting the first winch cable to the first end of said roller;

ii. a second winch drum having a second winch cable coupled to said bearing means for rotatably connecting the second winch cable to the second end of said roller; and iii. a winch stand for anchoring said winch system in proximity to the first edge of said area and for maintaining said first and second winch drums elevated above the surface of the plastic concrete.

15. The apparatus of claim 14 wherein said winch system further includes a spreader bar coupled to said winch stand, a first end extending outward from said winch stand to the first load bearing side surface and a second end extending outward from said winch stand to the second load bearing side surface for guiding said first and second winch cables outward from said winch stand to the first and second load bearing side surfaces of said area.

16. The apparatus of claim 15 wherein said spreader bar further includes:

a. a first pulley coupled to the first end of said spreader bar for redirecting the first winch cable along the first side surface of said area to said first bearing means; and b. a second pulley coupled to the second end of said spreader bar for redirecting the second winch cable along the second side surface of said area to said second bearing means.

* * * * *